US006382938B1

(12) United States Patent
Murao et al.

(10) Patent No.: US 6,382,938 B1
(45) Date of Patent: May 7, 2002

(54) COMPRESSOR HAVING STRUCTURE FOR SUPPRESSING PULSATION

(75) Inventors: Kazushige Murao; Satoshi Koumura; Fuminobu Enokijima; Takeshi Kawata, all of Kariya (JP)

(73) Assignee: Kabushiki Kaisha Toyoda Tidoshokki Seisakusho, Kariya (JP)

( * ) Notice: Subject to any disclaimer, the term of this patent is extended or adjusted under 35 U.S.C. 154(b) by 0 days.

(21) Appl. No.: 09/657,714

(22) Filed: Sep. 8, 2000

(30) Foreign Application Priority Data

Sep. 14, 1999 (JP) ..... 11-260292

(51) Int. Cl.[7] ..... F04B 11/00
(52) U.S. Cl. ..... 417/540
(58) Field of Search ..... 417/540, 269, 417/340, 222.2, 542, 437

(56) References Cited

U.S. PATENT DOCUMENTS 5,674,054 A * 10/1997 Ota et al. ..... 417/269
6,045,342 A * 4/2000 Kimura ..... 417/540
6,062,834 A * 5/2000 Masumoto et al. ..... 418/55.4
6,077,049 A * 6/2000 Nakamura et al. ..... 417/269
6,109,883 A * 8/2000 Kawaguchi et al. ..... 417/269
6,146,110 A * 11/2000 Higashihara ..... 417/269
6,227,812 B1 * 5/2001 Kawaguchi et al. ..... 417/22.2
6,267,563 B1 * 7/2001 Yamada et al. ..... 417/222.2

FOREIGN PATENT DOCUMENTS

JP 11-125178 5/1999

* cited by examiner

*Primary Examiner*—Teresa Walberg
*Assistant Examiner*—Vinod D. Patel
(74) *Attorney, Agent, or Firm*—Morgan & Finnegan, LLP

(57) ABSTRACT

A compressor that reduces pressure pulsation includes a mounting member for attaching the compressor to a vehicle support. The mounting member is integrally formed with an end wall of a rear housing member. A suction chamber and a discharge chamber are defined in the rear housing member. The discharge chamber is located outside the suction chamber and surrounds the suction chamber. An auxiliary chamber is formed in the mounting member. The auxiliary chamber is centrally located. The auxiliary chamber increases the volume of the suction chamber, which reduces pulsation. Since the auxiliary chamber is formed in the mounting member, neither the weight or the volume of parts that might interfere with other devices is increased.

16 Claims, 8 Drawing Sheets

COMPRESSOR HAVING STRUCTURE FOR SUPPRESSING PULSATION

BACKGROUND OF THE INVENTION

The present invention relates to a compressor having a structure for suppressing pulsation.

A typical compressor includes a rotatable shaft, piston s housed in cylinder bores, a suction chamber and discharge chamber. As each piston is reciprocated in the corresponding cylinder bore by rotation of the rotatable shaft, gas is drawn into the cylinder bore from the suction chamber, which is defined in a rear housing member. The gas is then compressed by the piston and discharged to the discharge chamber, which is defined in the rear housing member.

The discharge chamber suppresses pulsation of discharged gas, and the suction chamber suppresses pulsation of drawn gas. The greater the volume of the discharge chamber is , the more effectively the discharge pulsation suppression is. Also, the greater the volume of the suction chamber is, the more effective the suction pulsation suppression is.

Japanese Unexamined Patent Publication No. 11-125178discloses a compressor that suppresses discharge pulsation. The compressor of the publication has a bracket protruding from a rear housing member. The outer wall of the rear housing member bulges by the same amount as the bracket. The bulge is hollow, and the interior of tho bulge forms part of a discharge chamber. This structure e increases the volume of the discharge chamber, which improves the pulsation suppression without increasing the axial dimension of the compressor.

However, such expansion of the discharge chamber expands the total area of the walls defining the discharge chamber, which increases the weight of the compressor. Although the axial dimension of the compressor is not increased, the volume of the compressor increased. As a result, the compressor is more likely to interfere with other devices. The increased weight and size are disadvantageous when installing the compressor in a vehicle.

SUMMARY OF THE INVENTION

Accordingly, it is an objective of the present invention to provide a compressor that effectively suppresses pressure pulsation without increasing the weight of the compressor or the volume of any part that might cause interference during installation.

In accordance with the present invention, there is provided a compressor comprising a housing having a suction chamber and a discharge chamber defined therein. Gas is drawn from the suction chamber into cylinder bores and discharged from the cylinder bores into the discharge chamber by the reciprocating movement of a plurality of pistons driven by the rotation of a rotatable shaft. The housing is provided with a mounting member for attaching the compressor to a mounting object outside the compressor. The mounting member is fixed to the wall of the housing adjacent to at least one of the suction chamber and the discharge chamber. An auxiliary chamber that augments at least one of the suction chamber and the discharge chamber is formed by a recess in the wall at the location of the mounting member.

Other aspects and advantages of the invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which.

DETAILED DESCRIPTION OF THE PREFERRED EMBODIMENTS

Figure 1:
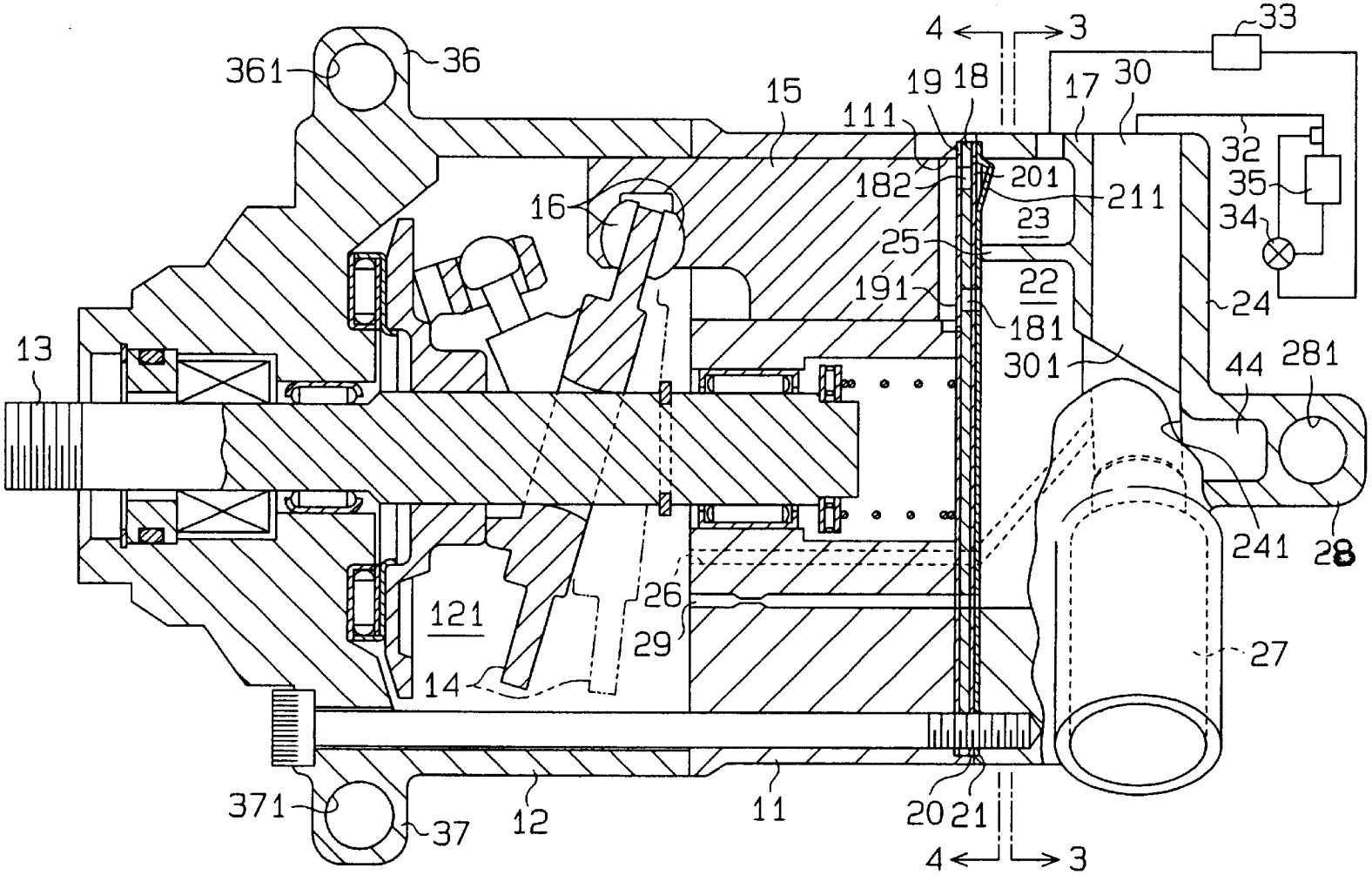
FIG. 1 is a cross-sectional view illustrating a compressor according to a first embodiment of the present invention.

In the drawings, like numerals are used for like elements throughout.

A variable displacement compressor according to a first embodiment of the present invention will now be described with reference to FIGS. 1 to 4. The compressor is used in a vehicle.

As shown in FIG. 1, the housing of the compressor includes a front housing member 12, a cylinder block 11 and a rear housing member 17. A control pressure chamber 121 is defined by the front housing member 12 and the cylinder block 11. A rotatable shaft 13 is supported by the front housing member 12 and the cylinder block 11 and is rotated by a vehicle engine (not shown). A swash plate 14 is supported by the rotatable shaft 13 in the control pressure chamber 121. The swash plate 14 rotates integrally with and inclines relative to the rotatable shaft 13. Cylinder bores 111, the number of which is six in this embodiment, are formed in the cylinder block 11 about the rotatable shaft 13. A piston 15 is housed in each cylinder bore 111. Rotation of the swash plate 14 is converted into reciprocation of each piston 15 by shoes 16.

Figure 3:
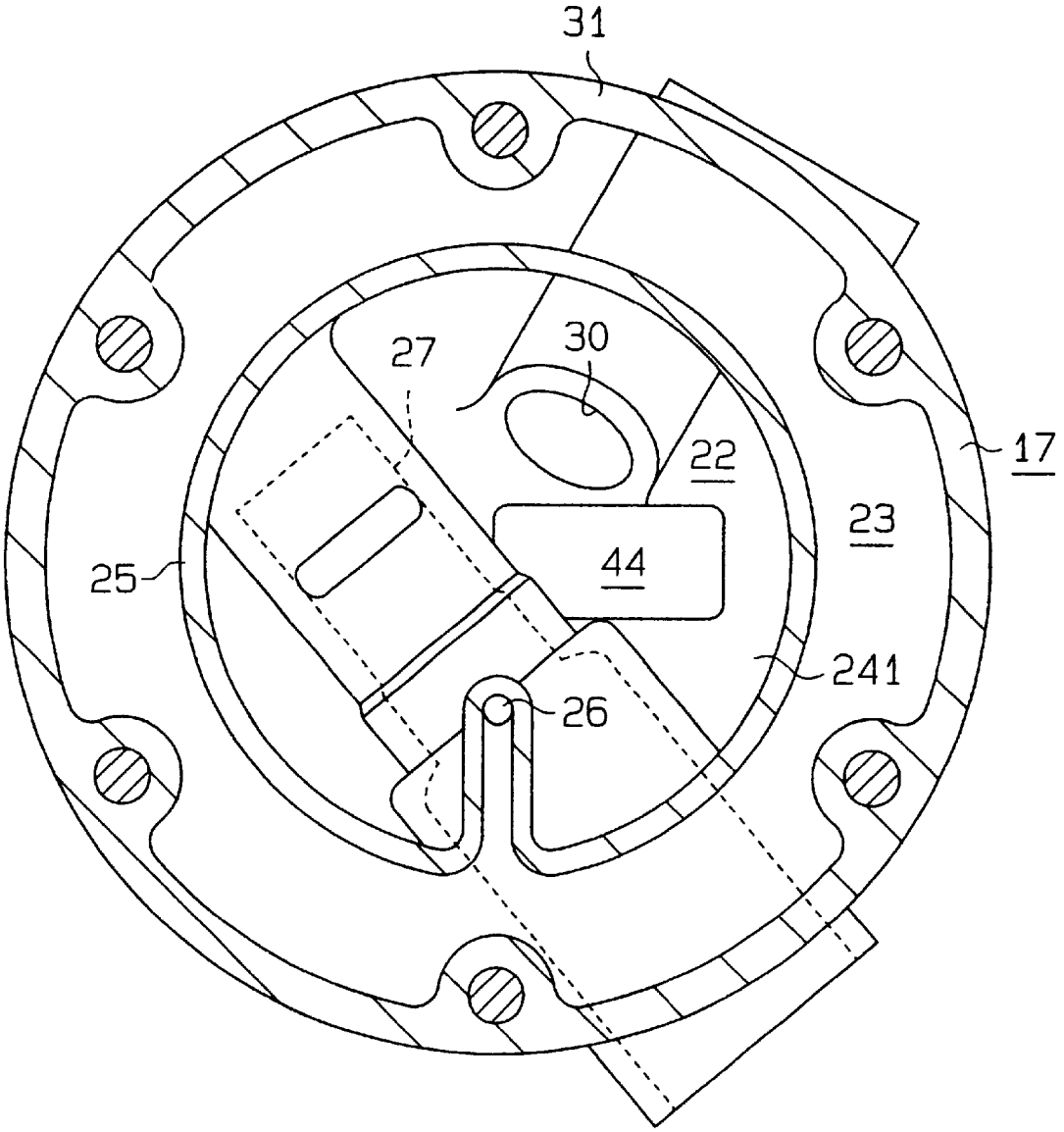
FIG. 3 is a cross-sectional view taken along line 3—3 of FIG. 1.
Figure 4:
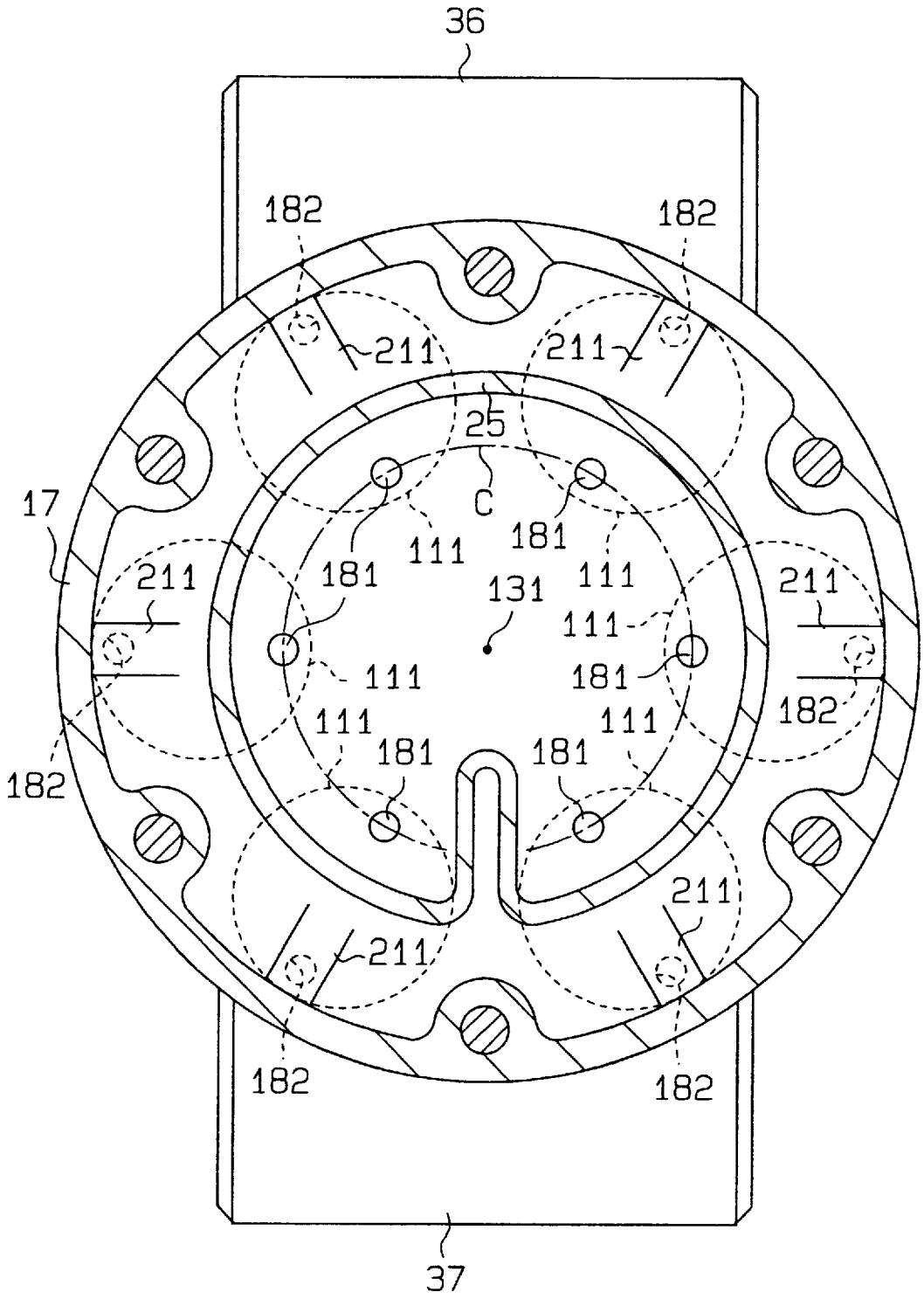
FIG. 4 is a cross-sectional view taken along line 4—4 of FIG. 1.

A rear housing member 17 is coupled to the cylinder block 11. A rear housing member 17 is secured to the cylinder block 11 with a valve plate 18, two valve flap plates 19, 20 and a retainer plate 21. A suction chamber 22, which is a suction pressure zone, and a discharge chamber 23, which is a discharge pressure zone, are defined in the rear housing member 17. As shown in FIGS. 3 and 4, the suction chamber 22 and the discharge chamber 23 are divided by a substantially annular wall 25. The wall 25 extends from an end wall 24 of the rear housing member 17 in the axial direction of the compressor. The discharge chamber 23 is located radially outside of the suction chamber 22.

Suction ports 181 are formed in the valve plate 18. As shown in FIG. 4, the suction ports 181 are located radially inside of the wall 25. Each suction port 181 corresponds to one of the cylinder bores 111. The suction ports 181 are arranged on a circle C centered on a point 131, which is on the axis of the rotatable shaft 13. Discharge ports 182 are formed in the valve plate 18. The discharge ports 182 are located radially outside of the wall 25. Each discharge port 182 corresponds to one of the cylinder bores 111. Suction valve flaps 191 are formed on the suction valve flap plate 19. Discharge valve flaps 201 are formed on the discharge valve flap plate 20. Each suction valve flap 191 opens and closes the corresponding suction port 181. Each discharge valve flap 201 opens and closes the corresponding discharge port 182.

A gas introduction passage 30 is formed adjacent to the end wall 24 of the rear housing member 17. The passage 30 extends from a circumferential wall 31 of the rear housing member 17 through the discharge chamber 23 and opens to the suction chamber 22. An outlet 301 of the passage 30 is located in the vicinity of the center point 131 of the circle C.

When each piston 15 is moved from the top dead center position to the bottom dead center position, refrigerant gas is drawn into the corresponding cylinder bore 111 from the suction chamber 22 through the corresponding suction port 181 and past the corresponding suction valve flap 191. When each piston 15 is moved from the bottom dead center position to the top dead center position, the refrigerant gas is compressed in the cylinder bore 111 and is then discharged to the discharge chamber 23 through the corresponding discharge port 182 and past the corresponding discharge valve flap 201. Retainers 211 are formed on the retainer plate 21 to limit the opening degree of the discharge valve flaps 201. Refrigerant in the discharge chamber 23 then flows to the suction chamber 22 through the external refrigerant circuit 32, which includes the condenser 33, the expansion valve 34, the evaporator 35 and the gas introduction passage 30.

The discharge chamber 23 is connected to the control pressure chamber 121 by a supply passage 26. The supply passage 26 supplies refrigerant from the discharge chamber 23 to the control pressure chamber 121. An electromagnetic displacement control valve 27 is located in the supply passage 26. The control valve 27 is controlled by a controller (not shown). The controller determines the value of current supplied to the control valve 27 based on the vehicle compartment temperature, which is detected by a compartment temperature sensor (not shown), and a target temperature, which is set by a temperature adjuster (not shown). The control valve 27 then operates based on the suction pressure in the suction chamber 22 and sets the actual suction pressure to a value that corresponds to the value of the supplied current. When the value of the supplied current is increased, the control valve 27 decreases the flow rate of refrigerant from the discharge chamber 23 to the control pressure chamber 121. Since refrigerant flows to the suction chamber 22 from the control pressure chamber 121 through a pressure release passage 29, the pressure in the control pressure chamber 121 decreases. Accordingly, the inclination angle of the swash plate 14 is increased, which increases the displacement of the compressor. The increase in the compressor displacement lowers the suction pressure. When the value of the supplied current is decreased, the control valve 27 increases the flow rate of refrigerant from the discharge chamber 23 to the control pressure chamber 121, which raises the pressure in the control pressure chamber 121. Accordingly, the inclination angle of the swash plate 14 decreases and the displacement is decreased. The decrease in the displacement raises the suction pressure. When the value of the current is zero, the opening degree of the control valve 27 is maximized, and the inclination angle of the swash plate 14 is minimized as illustrated by a broken line in FIG. 1.

Figure 2:
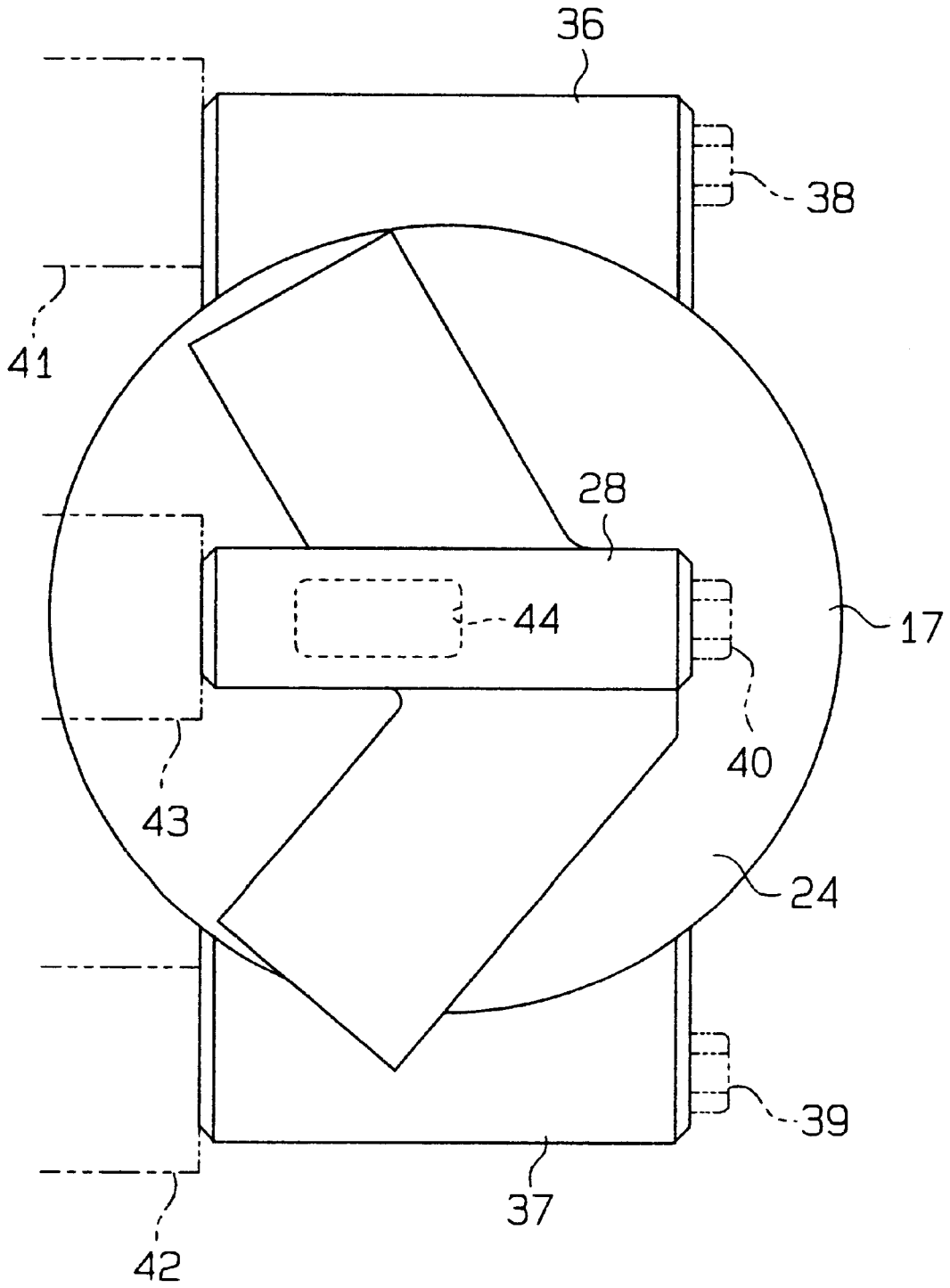
FIG. 2 is a rear view of the compressor shown in FIG. 1.

As shown in FIG. 1, mounting members 36, 37 are integrally formed with the front housing member 12 at the upper and lower surfaces. Bolt holes 361, 371 are formed in the mounting members 36, 37, respectively. The holes 361, 371 extend parallel to each other and perpendicular to the rotatable shaft 13. As shown in FIGS. 1 and 2, a mounting member 28 is formed integrally with the rear housing member 17 at the rear surface of the end wall 24. The mounting member 28 corresponds to the suction chamber 22 with the wall 24 in between. A bolt hole 281 is formed in the mounting member 28. The hole 281 extends parallel to the holes 361, 371 and perpendicular to the shaft 13.

As shown in FIG. 2, bolts 38, 39, 40 are inserted into the holes 361, 371, 281 to fix the compressor to supporting parts 41, 42, 43 within a vehicle's engine compartment.

As shown in FIGS. 1 and 3, the suction chamber 22 is surrounded by the wall 25 and the end wall 24 of the rear housing member 17. An auxiliary chamber 44 is formed in the mounting member 28. Specifically, the auxiliary chamber 44 is formed by an axially extending recess in the end wall 24 at the location of the mounting member 28. The auxiliary chamber 44 communicates with the suction chamber 22, which increases the volume of the suction chamber 22. An axial projection of the auxiliary chamber 44 includes the radial center of the suction chamber 22.

The first embodiment has the following advantages.

(1-1) The mounting members 28, 36, 37 are necessary for installing the compressor in the vehicle. The auxiliary chamber 44 is formed in the mounting member 28. Therefore, the volume of the suction chamber 22 is increased without increasing the weight and the volume of the compressor. The increase of the volume of the suction chamber 22 reduces the suction pulsation. Accordingly, noise and vibration created in the evaporator 35 due to the pulsation are reduced.

(1-2) The gas introduction passage 30 extends from the periphery of the compressor to the suction chamber 22. Therefore, the gas passage 30 is longer than the radial dimension of the discharge chamber 23. The passage 30 functions as a restrictor that reduces the suction pulsation.

(1-3) The outlet 301 of the passage 30 is near the center point 131 of the circle on which the suction ports 181 are located. The radial center of the suction chamber 22 lies within an axial projection of the auxiliary chamber 44. The suction chamber 22, which includes the auxiliary chamber 44, is generally cylindrical. The location of the outlet 301 is therefore spaced substantially equally from each suction port 181, which minimizes the pressure fluctuation at the outlet 301. Pressure fluctuations at the outlet 301 create suction pulsation, which is transmitted to the external refrigerant circuit 32 through the passage 30. The evaporator 35, which is located in the passenger compartment, is vibrated by an element of the pulsation that has a resonance frequency. However, since the pressure fluctuation is minimized, the suction pulsation is minimized. The noise caused by the vibration of the evaporator 35 is reduced, accordingly.

Figure 5:
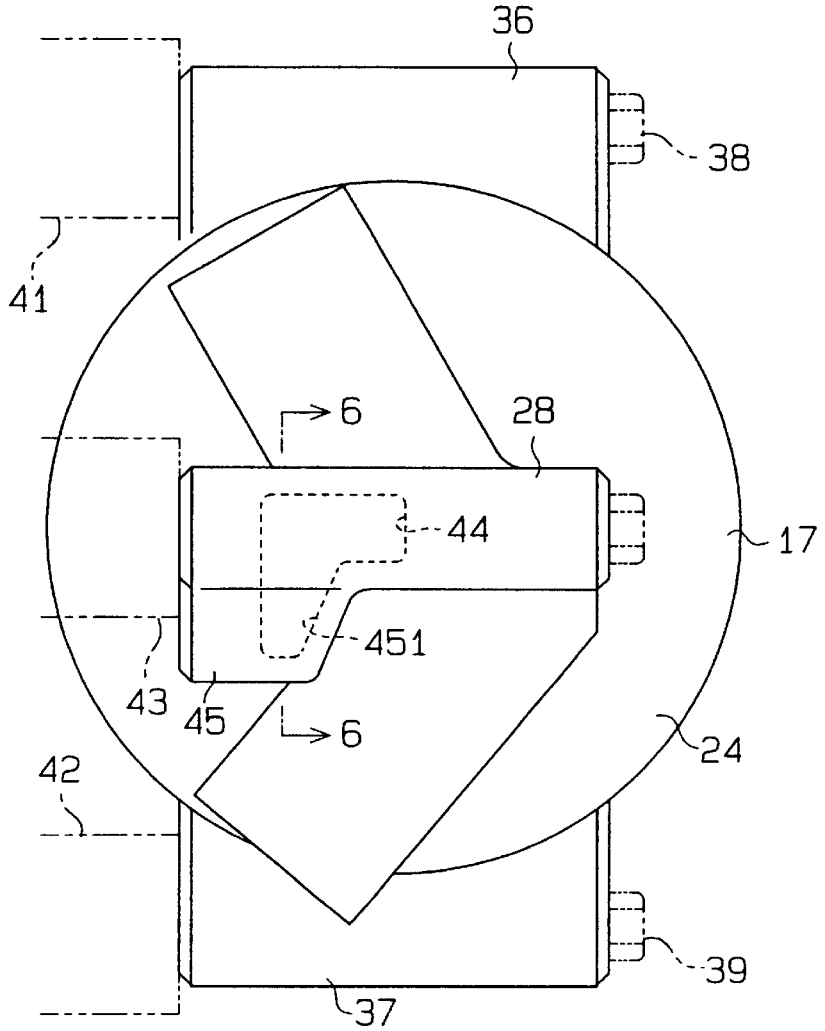
FIG. 5 is a rear view illustrating a compressor according to a second embodiment.
Figure 6:
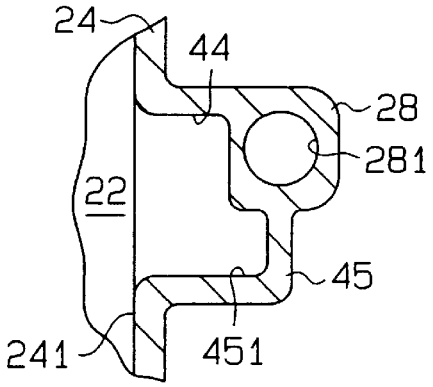
FIG. 6 is a cross-sectional view taken along line 6—6 of FIG. 5.

A second embodiment will now be described with reference to FIGS. 5 and 6. Like or the same reference numerals are given to those components that are like or the same as the corresponding components of the embodiment of FIGS. 1 to 4.

In this embodiment, a bulge 45 is formed in the mounting member 28. The bulge 45 however does not hinder the installation of the compressor due to its location. A second auxiliary chamber 451 is formed in the bulge 45. The second auxiliary chamber 451 is a recess formed in the surface 241 of the end wall 24 that faces the suction chamber 22. The auxiliary chambers 44, 451 form part of the suction chamber 22.

Figure 7:
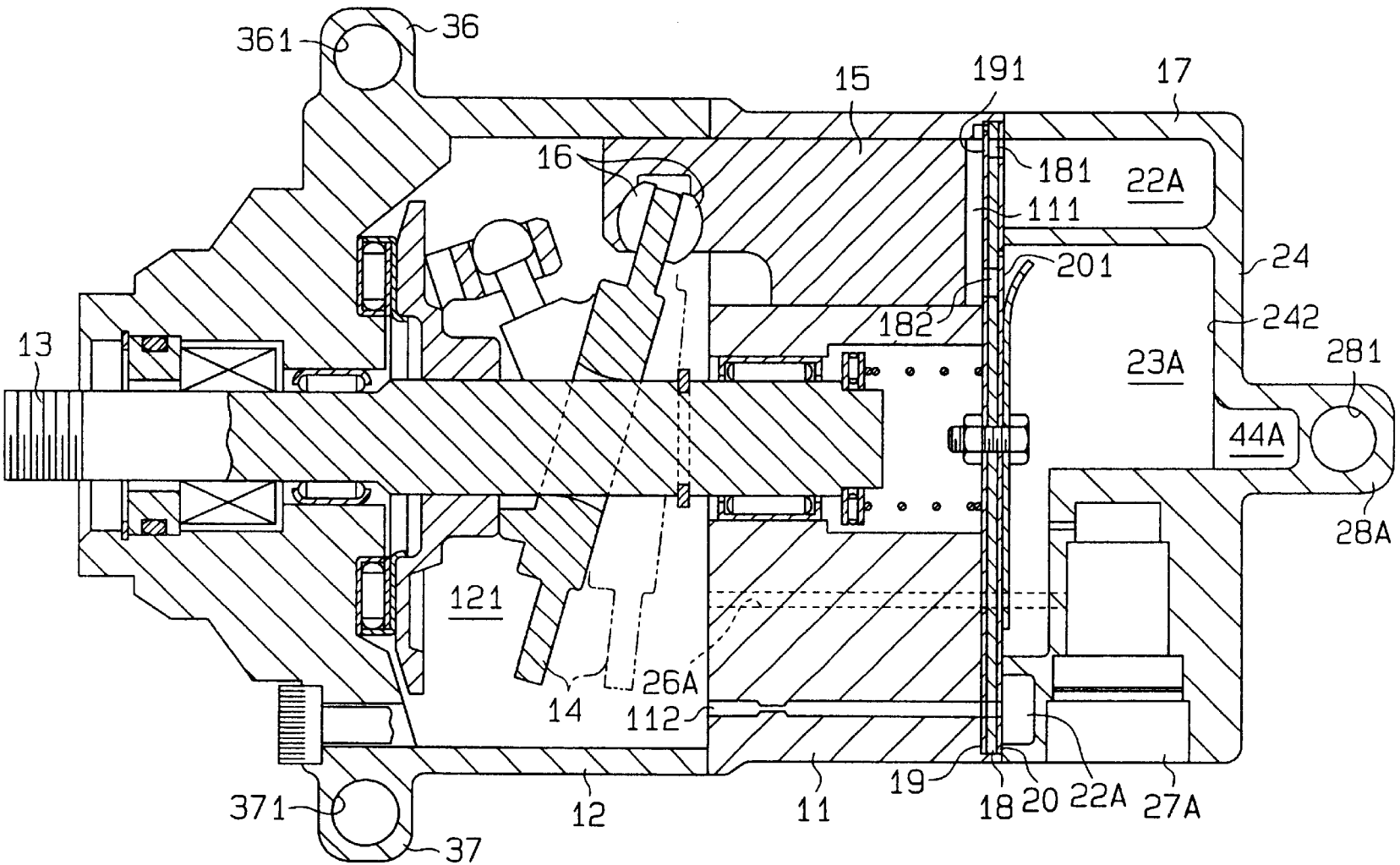
FIG. 7 is a cross-sectional view illustrating a compressor according to a third embodiment of the present invention.

A third embodiment will now be described with reference to FIG. 7. Like or the same reference numerals are given to those components that are like or the same as the corresponding components of the embodiment of FIGS. 1 to 4.

In this embodiment, a discharge chamber 23A is located radially inside in the rear housing member 17 and a suction chamber 22A is located radially outside of the discharge chamber 23A. A displacement control valve 27A controls the flow rate of refrigerant supplied from the discharge chamber 23A to the control pressure chamber 121 through a refrigerant supply passage 26A. Also, refrigerant flows from the control pressure chamber 121 to the suction chamber 22A through a pressure release passage 112, which has a throttle. The pressure in the control pressure chamber 121 is determined by the flow rate of refrigerant through the pressure release passage 112 and the flow rate of refrigerant from the control valve 27A to the control pressure chamber 121 through the refrigerant supply passage 26A.

An auxiliary chamber 44A is formed in a mounting member 28A and extends from the surface 242 of the end wall 24 of the discharge chamber 23A. The auxiliary chamber 44A forms part of the discharge chamber 23A. The volume of the discharge chamber 23A is increased by the volume of the auxiliary chamber 44A. The radial center of the discharge chamber 23A lies within an axial projection of the auxiliary chamber 44A.

The auxiliary chamber 44A, which is formed in the mounting member 28A, increases the volume of the discharge chamber 23A without increasing the weight and volume of the compressor. The augmentation of the discharge chamber 23A reduces the discharge pulsation.

It should be apparent to those skilled in the art that the present invention may be embodied in many other specific forms without departing from the spirit or scope of the invention. Particularly, it should be understood that the invention may be embodied in the following forms.

(1) In the illustrated embodiments, the auxiliary chambers 44, 44A extend from the surfaces 241, 242 of the end wall 24 into the interior of the mounting members 28, 28A, respectively. However, as long as the chambers 44, 44A are formed by axially extending recesses in the end wall 24 at the location of the mounting members 28, 28A, the chambers 44, 44A need not extend into the interior of the mounting members 28, 28A. In this case, if the auxiliary chambers are formed by recesses in the end wall at locations not corresponding to the mounting members, the strength of the wall at those locations is lowered. However, in the present invention, such a problem does not occur, because the recesses are formed in the end wall at the locations of the mounting members.

Figure 8:
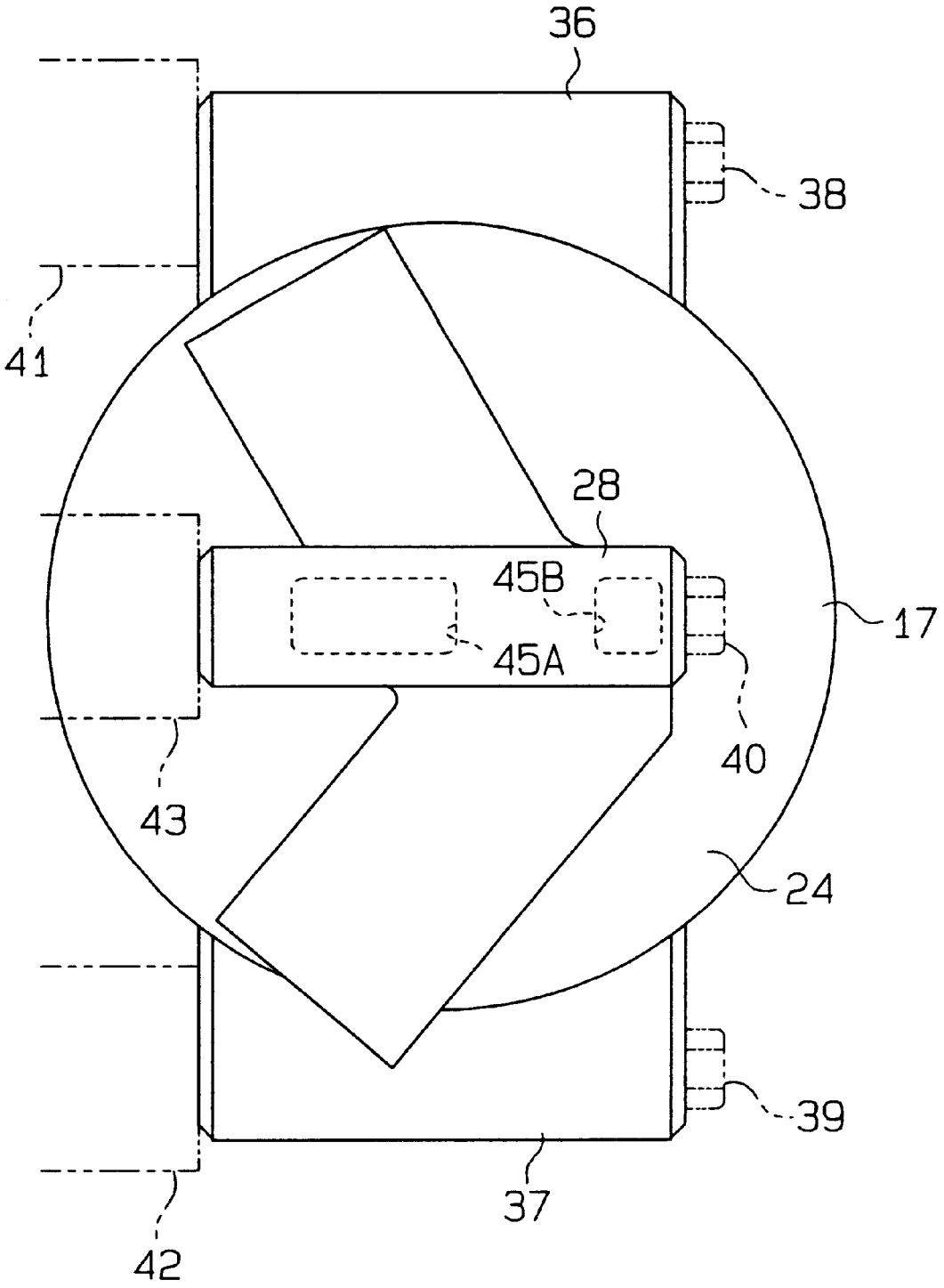
FIG. 8 is a rear view similar to FIG. 2 illustrating a compressor according to a fourth embodiment of the present invention.
Figure 9:
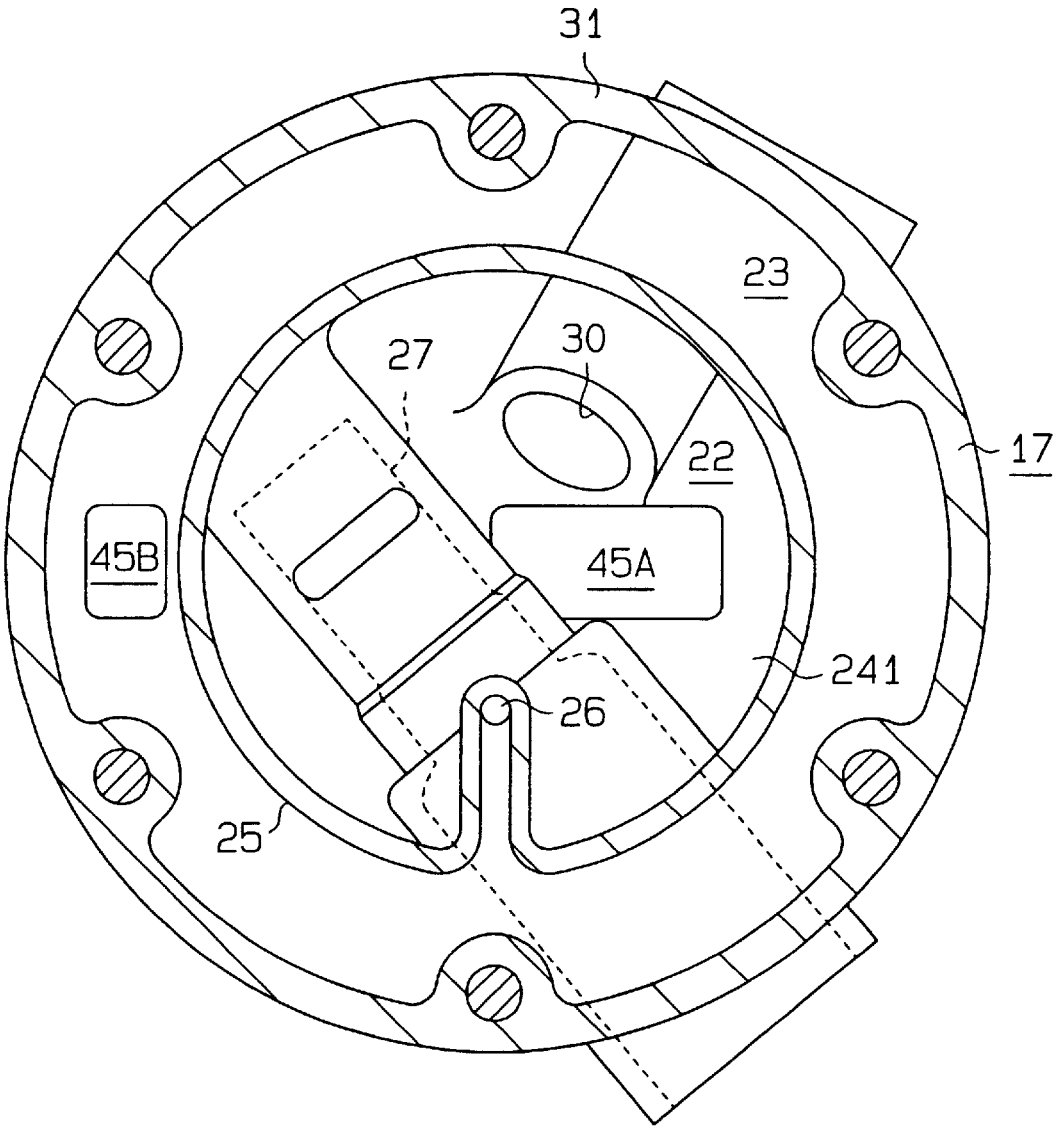
FIG. 9 is a cross-sectional view similar to FIG. 3 illustrating the compressor of FIG. 8.

(2) In each illustrated embodiment, the chamber 22 or 23A that is located inside is connected to the auxiliary chamber 44, 44A. However, if the rear housing member 17 has a mounting member that extends near both the suction chamber 22, 22A and the discharge chamber 23, 23A, two auxiliary chambers 45A, 45B may be formed to augment the suction chamber 22, 22A and the discharge chamber 23, 23A, respectively, as shown in FIGS. 8 and 9.

(3) The mounting members 28, 28A are integrally formed with the end wall 24 of the rear housing member 17. However, the mounting member 28, 28A may be formed on the circumferential wall 31. In this case, an auxiliary chamber may be formed in the mounting member to increase the volume of a peripheral chamber. That is, in the first and second embodiments, such an auxiliary chamber would increase the volume of the discharge chamber 23. In the third embodiment, such an auxiliary chamber would increase the volume of the suction chamber 22A.

Therefore, the present examples and embodiments are to be considered as illustrative and not restrictive and the invention is not to be limited to the details given herein, but may be modified within the scope and equivalence of the appended claims.

What is claimed is:

1. A compressor comprising:

a rotatable shaft;

a housing having a wall, wherein a suction chamber and a discharge chamber are defined by the wall;

a piston that is reciprocated by the rotation of the rotatable shaft, wherein the piston causes gas to be drawn from the suction chamber and to be discharged into the discharge chamber;

a mounting member for attaching the compressor to a support, wherein the mounting member is fixed to the wall, and the mounting member is adjacent to at least one of the suction chamber and the discharge chamber; and an auxiliary chamber that augments at least one of the suction chamber and the discharge chamber, the auxiliary chamber being formed by a recess in the wall at the location of the mounting member.

2. A compressor according to claim 1, wherein the auxiliary chamber extends into the interior of the mounting member.

3. A compressor according to claim 1, wherein the suction chamber is located radially inward of the discharge chamber, wherein the mounting member is located adjacent to the suction chamber.

4. A compressor according to claim 3, wherein the auxiliary chamber is located near the axis of the rotatable shaft.

5. A compressor according to claim 3, further comprising a gas introducing passage provided in the housing, wherein the gas introducing passage extends between the periphery of the compressor and the suction chamber.

6. A compressor according to claim 1, wherein the discharge chamber is located radially inward of the suction chamber, wherein the mounting member is located adjacent to the discharge chamber.

7. A compressor according to claim 6, wherein the auxiliary chamber is located near the axis of the rotatable shaft.

8. A compressor according to claim 1, wherein the housing includes an outer peripheral wall, an end wall and a partition separating the suction chamber from the discharge chamber, and the mounting member is located on the end wall.

9. A compressor according to claim 1, wherein the mounting member is adjacent to both the suction chamber and the discharge chamber.

10. A compressor according to claim 9, wherein the auxiliary chamber includes a first chamber and a second chamber that augment the suction chamber and the discharge chamber, respectively, the first chamber and the second chamber being formed respectively by recesses in the wall.

11. A compressor according to claim 10, wherein each of the first chamber and the second chamber extends into the interior of the mounting member.

12. A compressor comprising:

a rotatable shaft;

a housing that includes a suction chamber and a discharge chamber, wherein the housing includes an outer peripheral wall, an end wall, and a partition, which separates the suction chamber and the discharge chamber from one another, wherein the suction chamber is radially inward of the discharge chamber;

a piston that is reciprocated by the rotation of the rotatable shaft, wherein the piston causes gas to be drawn from the suction chamber and to be discharged into the discharge chamber;

a mounting member for attaching the compressor to a support, the mounting member being located on the end wall adjacent to the suction chamber; and an auxiliary chamber formed by a hollow that extends from the suction chamber to the interior of the mounting member to increase the volume of the suction chamber.

13. A compressor according to claim 12, wherein the auxiliary chamber is located near the axis of the rotatable shaft.

14. A compressor according to claim 12, further comprising a gas introducing passage provided in the housing, wherein the gas introducing passage extends between the periphery of the compressor and the suction chamber.

15. A compressor comprising:

a rotatable shaft;

a housing that includes a suction chamber and a discharge chamber, wherein the housing includes an outer peripheral wall, an end wall, and a partition, which separates the suction chamber and the discharge chamber from one another, wherein the discharge chamber is radially inward of the suction chamber;

a piston that is reciprocated by the rotation of the rotatable shaft, the piston causing gas to be drawn from the suction chamber and to be discharged into the discharge chamber;

a mounting member for attaching the compressor to a support, the mounting member being located on the end wall adjacent to the discharge chamber; and an auxiliary chamber formed by a hollow that extends from the discharge chamber to the interior of the mounting member to increase the volume of the discharge chamber.

16. A compressor according to claim 15, wherein the auxiliary chamber is located near the axis of the rotatable shaft.

* * * * *